United States Patent [19]

Dathe et al.

[11] 3,984,135

[45] Oct. 5, 1976

[54] WINDOW DEAD BOLT AND LATCH LOCKING DEVICE

[76] Inventors: Bernard E. Dathe, 265 Oakpark Lane, Pleasant Hill, Calif. 94523; James Douglas Franklin, 327 Covington St., Oakland, Calif. 94605; Henry Gordon Brian Gough, 1115 Zephyr Place, Danville, Calif. 94526; Wesley Howard Kollmorgan, Jr., 3550 Savage Ave., Pinole, Calif. 94564; Lance Andrew Porter, 11115 Ettrick St., Oakland, Calif. 94605

[22] Filed: Feb. 14, 1975

[21] Appl. No.: 549,955

[52] U.S. Cl. ..... 292/4; 292/57; 292/DIG. 20

[51] Int. Cl.[2] ..... E05C 5/00

[58] Field of Search ..... 292/4–5, 292/57–62, DIG. 20; 49/449, 450, 453

[56] References Cited

UNITED STATES PATENTS

| | | | |
|---|---|---|---|
| 738,465 | 9/1903 | Meyer | 292/4 |
| 922,899 | 5/1909 | Hissong | 292/4 |
| 1,427,253 | 8/1922 | Appleby | 292/4 X |
| 1,446,459 | 2/1923 | Heppler | 292/4 X |
| 3,893,261 | 7/1975 | Gribben | 49/449 |

*Primary Examiner*—Robert L. Wolfe
*Attorney, Agent, or Firm*—Robert R. Tipton

[57] ABSTRACT

A locking and dead bolt locking device associated with the upper rail or frame portion of a window or door sash slideable in a fixed frame, having a latching arrangement engaging a horizontal rail portion and a dead bolt arrangement engaging the frame and mounted on an upper portion of the sash. The latching arrangement includes a tongue latch portion operable normal to the plane of the window and with the dead bolt being integrally carried thereby. When closed, the tongue portion of the latch engages a striker plate of said rail while the deadbolt is engaged with the frame to prevent opening of said latch. Simultaneously, the sash is secured with respect to the frame thereby providing a dual means for securing the sash in a close position in said frame.

7 Claims, 4 Drawing Figures

WINDOW DEAD BOLT AND LATCH LOCKING DEVICE

BACKGROUND OF THE INVENTION

This invention is related generally to a device for securing a slideable door or window sash in a closed position in a fixed frame and more particularly, to an integral latching and deadbolt lock device for securing a slideable sash in a mounted frame.

Heretofore there has been development of a multitude of devices which provide latching or locking functions either singly or in combination. With simple arrangements such devices usually may be easily opened from the outside, they lack mechanical strength and are otherwise relatively ineffective for maintaining the sash in a closed position secure against undesirable intrusion. Combination devices heretofore proposed generally are relatively complicated and costly to manufacture as well as requiring considerable maintenance. Often they require separate and easily misplaced supplemental means to effect operation or are complicated in operation so as to unduly delay opening thereof from the interior, e.g., in the case of an emergency. A need therefore exists for a device for conveniently and positively securing a sash within a frame with regard to external intrusion while permitting rapid and certain opening operations from within when needed.

SUMMARY OF THE INVENTION

Generally speaking the device of the present is employed with an arrangement in which at least one lower sash for a door or window is slideable inside channels provided in a fixed frame mountable in an appropriate building opening. For the purpose of the invention the uppermost member of said sash is provided with a cap member portion having an upwardly facing channel or groove therein. Securing functions of the device are provided by an integral locking and latching member having a downwardly projecting pivotal leg portion adapted to be disposed in the aforesaid channel, a latch block portion projecting generally outward together with a handle protion projecting generally inward with respect to said sash. Further, said member is provided with a bore extending parallel to the plane of said sash for receiving a generally cylindrical bolt member therein.

The lock and latch member is generally positioned proximate one side edge of said sash with the pivot leg portion positioned within said upwardly facing groove in the cap member in a position such that said bolt member may be retractably inserted into said bore or similar suitable perforation provided in an ajacent frame member.

When the bolt and latch member is so disposed the latching blade portion projects outwardly to engage a striker plate or stop construction provided on a transfer rail or the like. Therefore when the bolt member is positioned to engage the perforated frame member the latch block is simultaneously firmly secured in latching relation to said transverse rail portion. Accordingly, operation of the bolt provides a duplex simultaneous locking and latching engagement of the sash with respect to the frame and rail members as described. To effect opening of the sash it is merely necessary to retract said bolt member and depress the handle portion of the lock and latch member whenceforth the lower sash may be freely raised. Moreover, said rail member may be positioned on the lower frame portions of a second sash so that the second sash is simultaneously locked.

Accordingly it is a general object of the invention to provide a device for securly latching door and window sashes.

Another object of the invention is to provide a device for securing at least one window or door sash in a fixed frame in which device a duplex latching and deadbolt relation is simultaneously achieved.

A further object of the invention is to provide a window or door sash locking device with a combination deadbolt and latch member in which a single deadbolt portion securely locks the sash.

Still other objects and advantages features will be apparent in the following description taken in conjunction with the accompaning drawings.

DESCRIPTION OF THE PREFERRED EMBODIMENT

Figure 1:
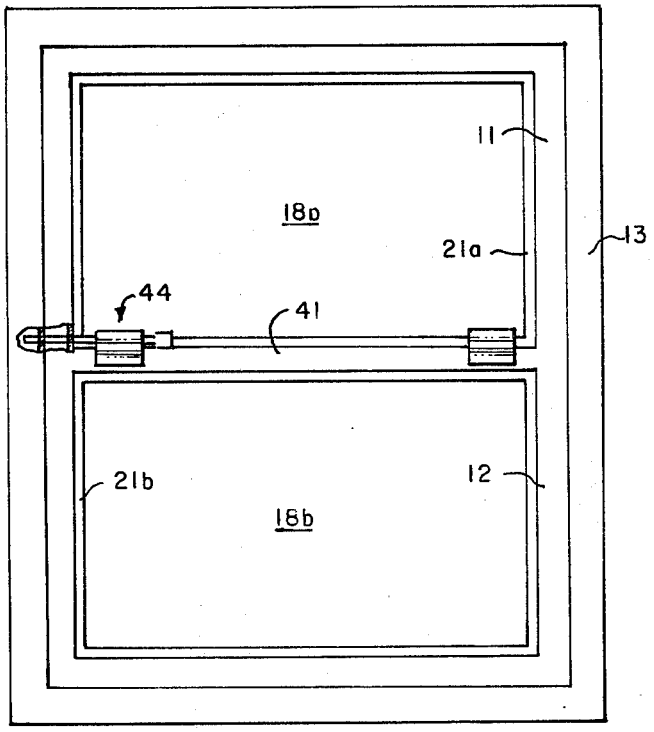
FIG. 1 is an inside elevational drawing of a window construction employing the deadbolt and latch device of the present invention.
Figure 2:
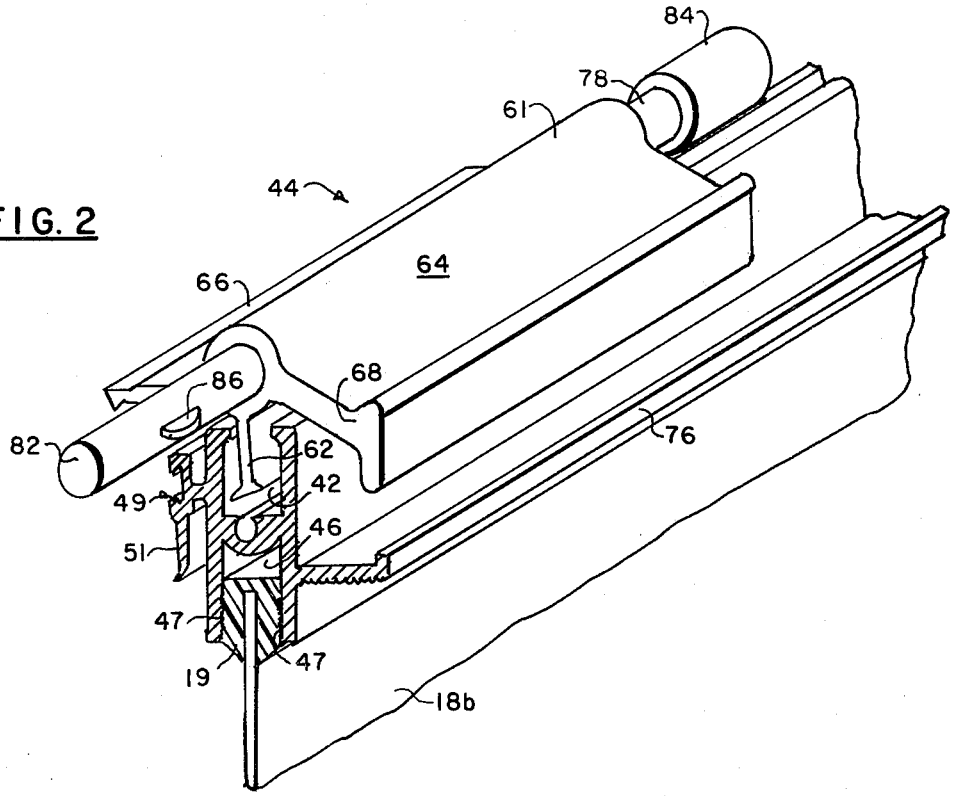
FIG. 2 as an isometric view illustrating details of the device of FIG. 1.
Figure 3:
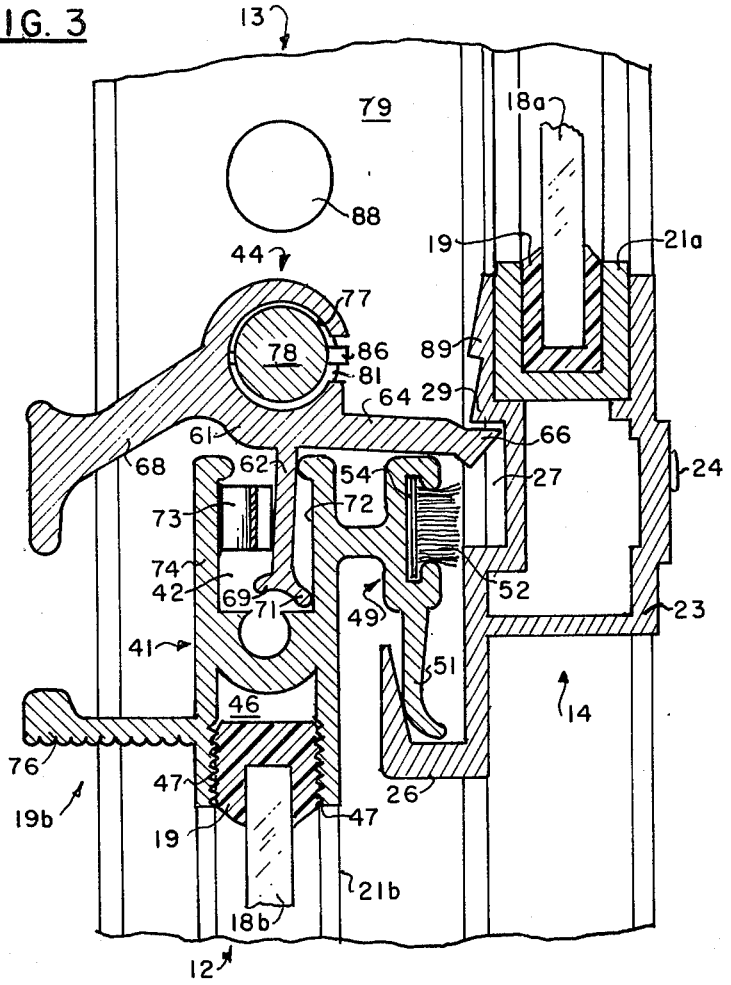
FIG. 3 is a verticle cross-sectional view of the device of FIGS. 1 and 2.
Figure 4:
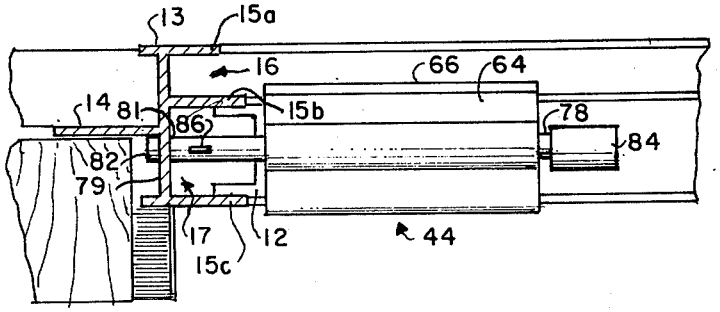
FIG. 4 is a plan view of the devices of FIGS. 1–3 showing the bolt of the foregoing device in closed position.

With reference to FIG. 1 of the drawing an embodiment of the deadbolt and latch constructed in accordance with the teachings of the invention is shown as arranged in association with upper and lower window sashes 11 and 12, respectively, mounted in a fixed frame 13. The sashes and frame are of a substantial conventional construction. More specifically, with further reference to FIG. 4 frame 13 may be a so-called, "nail-on" type formed of aluminum extrusions having a nail-on flange 14 being shown in FIG. 4 as secured in a typical building construction. Frame 13 includes inner peripheral flange members of which respective pairs define an outermost channel 16 in which upper sash 11 is mounted in a raised fixed position together with an innermost channel 17 in which sash 12 is positioned in a slideable relation. Sashes 11 and 12 may comprise window or door panes or panels **18*a*, 18*b*, respectively, secured as by means of resilient gaskets 19 within channeled frame members 21*a*, 21*b***, respectively as shown in FIG. 3.

The edges of frame member **21*b*** may also be channeled or otherwise adapted to include friction reducing pads (not shown), e.g., of molded nylon and/or be provided with counter balancing means (not shown) as in conventional practice.

For retaining upper sash 11 in fixed relation in frame channel 16, there is provided a transverse bar member 23 having the ends thereof secured to frame 13 as by means of metal screws or rivets 24, or otherwise as by spot welding (not shown). Bar member 23 defines an upper longitudinal slot in which the bottom edge of bar frame member **21*a* of sash 11 is seated. The inside lower edge of bar member 23 may also be provided with an inwardly depending trough like portion 26. An inner side surface of bar 23 defines at least one indented longitudinal groove 27** which serves as a stop portion of the latch arrangement of the invention. Such inside surface of bar 23 may also be provided with additional ratchet tooth-like ridges 29 above groove 27 serving as supplementary stops. It will be appreciated that bar member 23 may be, conveniently, an appropriate length of an extruded aluminum form.

The lower sash 12 is provided with a cap member 41 having a longitudinal groove or channel 42 in the upper surface thereof which groove is utilized for positioning an integral latching and locking member 44 in accordance with the invention.

More specifically, cap member 41 can be formed of aluminum, e.g., as by extrusion. A second generally retangular groove or channel 46 is defined in lower portion of cap member 41 substantially directely below groove 42 which channel 46 engages the upper transverse portion of frame 21*b*. Serrations 47 may be provided in the side walls of groove 46 to provide a positive grip on frame 21*b*. When sash 12 is in a lower closed position, cap member 41 partially overlaps transverse bar member 23 with the upper side thereof positioned somewhat below the longitudinal groove 27. Cap member 41 may also be provided with a vent style portion 49, projecting toward bar 23 and having a depending tongue portion 51 which fits into trough 26. The foregoing arrangement together with weather-strip 52 positioned in a groove 54 above tongue 51 in style 49 provides for weather tightness between the overlapping cap and bar members 41 and 23, respectively. Any other comparable weather-stripping design may likewise be employed.

The integral latching and locking member 44 may be considered to comprise a central body 61 having a dependent pivot leg member 62 positioned in channel 42 and a latch blade means 64 projecting outwardly therefrom over vent style 49 wherefore the beveled end 66 thereof engages the upper side wall of groove 27 in bar member 23.

A handle bar portion 68 projects inwardly from body 61. The pivot leg member terminates downwardly in a foot portion 69 having an angularly disposed toe 71 which bears upon the outer sidewall 72 of channel 42. A spring leaf member 73 is disposed between the inward channel wall 74 and pivot leg 62 to compliantly force the end 66 of latch blade 64 into groove 27 of the horizontal bar 23 when the sash 12 is in a closed position.

A lift ridged means 76 may be provided on the upper transverse member of frame 19*b* to facilitate manual depression of handle 68 and lifting of the sash 12 in sash opening operations.

As a prime feature of the invention the central body portion 61 of member 44 is provided with a longitudinal bore 77 in which a sliding cylindrical bolt 78 is positioned. An upright side portion 79 of frame 13 defining the bottom of channel 17 may be provided with a perforation 81 into which an end 82 of bolt 78 may be inserted with the sash in a closed position. Means such as a knurled cap 84 or a lever arm (not shown) may be provided on the other end of bolt 78 to facilitate insertion and retraction of bolt 78 with respect to perforation 81. Also a resilient spring means (not shown) may be used to urge bolt 78 sideways to engage said frame. Bolt 78 may be provided with projections 86 to maintain it in bore 77.

For opening the lower sash 12, bolt 78 is retracted to disengage the end 82 thereof from perforation 81. Accordingly, handle 68 may be depressed and the sash raised using lift means 76. For closing and locking said sash 12 the foregoing operations are performed in reverse order. It will be observed that in the closed position the bolt 78 provides a deadbolt function as between the sash and frame as well as, at the same time, serving a similar locking function with respect to maintaining latch lock end 66 in groove 27. The sash is accordingly retained in closed position by a duplex deadbolt and latch locking function.

To assure positive and secure locking it is important that the bolt be positioned substantially directly over or outwardly with respect to the pivot joint of member 62 otherwise forceable lifting of sash 12 could cause sufficient rotation of member 44 to disengage latch tip 66 from groove 27. Certain modifications may be made. For example, one or more other perforations 88 may be provided in frame member 79 to allow restricted raising of the sash, e.g., for ventilation purposes. Ratchet like teeth 89 on the sash frame 21 may be added to effect latching as above. With an appropriate small spacing of the other perforations 88 it would still be difficult to effect operation from the outside, e.g., to introduce an arm and manipulate the deadbolt latch positioned as it is at the top of the sash. Moreover, the upper sash may also be slideable with the cross bar 23 being carried by the upper sash. Also to provide additional security against dislodging bolt 78 from perforation 81, the latter may have a keyhole configuration, e.g., to receive, e.g., projection 86. Rotation of bolt 78 then locks the bolt in the perforations 81 (or 88).

While there has been described in the foregoing what may be considered to be preferred embodiments of the invention modifications may be made therein without departing from the teachings of the invention and it is intended to cover all such as fall within the scope of the appended claims.

We claim:

1. A deadbolt latch and locking device for securing a door or window having at least one sash slideable in a fixed frame comprising cross bar means defining a latch stop and positioned proximate the upper side of said sash, cap member means associated with the upper side of said sash and defining means for positioning a pivotal member thereon, an integral member comprising a rotatable body portion having a dependent pivot leg member engaging said pivotal positioning means of the cap member, together with a latch blade or tongue portion positionable to engage the latch stop of said cross bar means, said integral member defining a longitudinal bore a generally cylindrical retractable bolt disposed in the bore of said integral member and adapted to engage said fixed frame and thereby prevent rotation of said integral member thereby simultaneously locking said sash with respect to said frame and to secure said latch blade in engagement with said latch stop of said cross bar means.

2. The deadbolt latch and locking device as defined in claim 1 wherein said door and window comprises a second upper sash in said frame and, said cross bar means is associated with the lower edge of said upper sash said cross bar being mounted to secure said sash in fixed relation in said frame.

3. The deadbolt latch and locking device as defined in claim 1 wherein said door or window comprises a second upper sash slideable in said frame, and said cross bar means is associated with the lower edge of said sash.

4. The deadbolt latch and locking device as defined in claim 2 wherein said fixed frame further defines one stop perforation at a location appropriate to receive the end of said retractable bolt so as to prevent rotation of said integral member.

5. The deadbolt latch and locking device as defined in claim 4 wherein said stop perforation has a keyhole configuration and said bolt includes projections adapted to enter said perforation and retain said bolt therein upon rotation thereof.

6. The deadbolt latch and locking device as defined in claim 2 wherein said means for positioning a pivotal member comprises a channel formed in said cap member and adapted to receive said pivot leg member and wherein said bolt is positioned no further inwardly with respect to said sash then substantially directly above the pivot point of said pivot member.

7. The deadbolt latch and locking device of claim 6 wherein said retractable body portion of the integral member includes a lever handle portion extending oppositely to said latch blade and inwardly of said sash.

* * * * *